US009547268B2

(12) United States Patent
Yamamoto et al.

(10) Patent No.: US 9,547,268 B2
(45) Date of Patent: Jan. 17, 2017

(54) IMAGE FORMING APPARATUS, AND METHOD AND COMPUTER-READABLE MEDIUM FOR THE SAME

(71) Applicant: Brother Kogyo Kabushiki Kaisha, Nagoya-shi, Aichi-ken (JP)

(72) Inventors: Tomoya Yamamoto, Kasugai (JP); Saya Minoshima, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/071,609

(22) Filed: Mar. 16, 2016

(65) Prior Publication Data

US 2016/0274522 A1 Sep. 22, 2016

(30) Foreign Application Priority Data

Mar. 18, 2015 (JP) ..... 2015-054538

(51) Int. Cl.
*G03G 15/00* (2006.01)
*G03G 21/20* (2006.01)

(52) U.S. Cl.
CPC ..... *G03G 15/5045* (2013.01); *G03G 21/20* (2013.01)

(58) Field of Classification Search
CPC ..... G03G 15/5045; G03G 21/20
USPC ..... 399/44
See application file for complete search history.

(56) References Cited

U.S. PATENT DOCUMENTS

| | | | | |
|---|---|---|---|---|
| 7,105,804 | B2 | 9/2006 | Saka | |
| 7,761,018 | B2 * | 7/2010 | Etoh | G03G 15/235 399/44 |
| 2005/0194525 | A1 | 9/2005 | Saka | |

FOREIGN PATENT DOCUMENTS

| | | | |
|---|---|---|---|
| JP | H06-194921 | A | 7/1994 |
| JP | H11-038861 | A | 2/1999 |
| JP | 2001-194980 | A | 7/2001 |
| JP | 2004-333930 | A | 11/2004 |
| JP | 2005-134413 | A | 5/2005 |
| JP | 2005-250250 | A | 9/2005 |
| JP | 2006-227559 | A | 8/2006 |

* cited by examiner

*Primary Examiner* — Hoang Ngo
(74) *Attorney, Agent, or Firm* — Banner & Witcoff, Ltd.

(57) ABSTRACT

An image forming apparatus including a first temperature sensor inside a space between frames, a second temperature sensor outside the space between the frames, and a controller that, in a case where a first temperature by the first temperature sensor is higher than an inside threshold temperature, and a second temperature by the second temperature sensor is higher than an outside threshold temperature, performs simplex image formation at a first speed when simplex image formation is specified, and performs duplex image formation at a second speed lower than the first speed when duplex image formation is specified, and in at least one of a case where the first temperature is equal to or less than the inside threshold temperature and a case where the second temperature is equal to or less than the outside threshold temperature, performs image formation at the first speed.

14 Claims, 10 Drawing Sheets

| THRESHOLDS | TEMPERATURE (°C) |
|---|---|
| A | 44 |
| B | 42 |
| C | 36.5 |
| D | 44 |
| E | 42 |
| F | 40 |
| K | 32.5 |

FIG. 5

IMAGE FORMING APPARATUS, AND METHOD AND COMPUTER-READABLE MEDIUM FOR THE SAME

CROSS-REFERENCE TO RELATED APPLICATION

This application claims priority under 35 U.S.C. §119 from Japanese Patent Application No. 2015-054538 filed on Mar. 18, 2015. The entire subject matter of the application is incorporated herein by reference.

BACKGROUND

Technical Field

The following description relates to an image forming apparatus configured to electrophotographically form an image on a sheet, more particularly to one or more techniques for sheet conveyance control according to temperature inside the apparatus.

Related Art

It has been known that, in an electrophotographic image forming apparatus, owing to a higher temperature inside the apparatus, undesired problems are more likely to occur such as malfunctions caused due to deformation of resin components and a lowered level of printing quality due to melting of toner. Thus, for the image forming apparatus, such a technique has been known as to, when the temperature (hereinafter referred to as "in-apparatus temperature") inside the apparatus exceeds a particular temperature, restrict a printing operation and perform a cooling operation to make the in-apparatus temperature lower.

For instance, an image forming apparatus has been known that includes a temperature sensor disposed at a ventilating duct of a cooling fan, and a temperature sensor disposed inside a fuser assembly. The image forming apparatus is configured to control a rotational speed of a fixing roller of the fuser assembly and a rotational speed of the cooling fan, based on signals output from the temperature sensors.

SUMMARY

However, the known image forming apparatus has the following problems. Since the cooling operation restricts the printing operation, it is preferable to minimize an execution frequency of the cooling operation as much as possible. Therefore, for the image forming apparatus, it is desired to prevent a rise in the in-apparatus temperature even before the in-apparatus temperature reaches a predetermined temperature as a condition required for execution of the cooling operation.

As one of examples to increase the in-apparatus temperature, duplex printing is cited. In the duplex printing, a sheet heated via a fuser assembly is conveyed inside the image forming apparatus for a long period of time. Thus, in comparison with simplex printing, a quantity of heat taken away by sheets per unit time is smaller, and the in-apparatus temperature rises more easily. The known image forming apparatus includes a plurality of temperature sensors, and is configured to change control modes depending on temperature inside or outside the apparatus. Nonetheless, the image forming apparatus is not configured to change control modes depending on whether the apparatus performs duplex printing or simplex printing. Thus, in this respect, the image forming apparatus is desired to be further improved.

Aspects of the present disclosure are advantageous to provide one or more improved techniques, for an image forming apparatus capable of duplex printing, which make it possible to take appropriate sheet conveyance control according to temperature.

According to aspects of the present disclosure, an image forming apparatus is provided, which includes a plurality of frames, an image forming assembly supported by the plurality of frames, the image forming assembly being configured to perform image formation on a sheet, a first temperature sensor disposed inside a space between the plurality of frames, the first temperature sensor being configured to detect a first temperature inside the space between the plurality of frames by outputting a signal corresponding to the first temperature, a second temperature sensor disposed outside the space between the plurality of frames, the second temperature sensor being configured to detect a second temperature outside the space between the plurality of frames by outputting a signal corresponding to the second temperature, and a controller configured to, when the first temperature detected by the first temperature sensor is higher than an inside threshold temperature, and the second temperature detected by the second temperature sensor is higher than an outside threshold temperature, and simplex image formation is specified as the image forming mode, control the image forming assembly to perform image formation on a single side of the sheet while conveying the sheet at a first conveyance speed, when the first temperature detected by the first temperature sensor is higher than an inside threshold temperature, and the second temperature detected by the second temperature sensor is higher than an outside threshold temperature, and duplex image formation is specified as the image forming mode, control the image forming assembly to perform image formation on both sides of the sheet while conveying the sheet at a second conveyance speed, the second conveyance speed being lower than the first conveyance speed, and in at least one of a case where the first temperature is equal to or less than the inside threshold temperature and a case where the second temperature is equal to or less than the outside threshold temperature, control the image forming assembly to perform image formation on the sheet while conveying the sheet at the first conveyance speed.

According to aspects of the present disclosure, further provided is a method adapted to be implemented on a processor coupled with an image forming apparatus, the image forming apparatus including a plurality of frames, an image forming assembly supported by the frames, a first temperature sensor, and a second temperature sensor, the method including determining whether a second temperature detected by the second temperature sensor is equal to or less than an outside threshold temperature, the second temperature sensor being disposed outside a space between the plurality of frames, the second temperature sensor being configured to detect the second temperature outside the space between the plurality of frames by outputting a signal corresponding to the second temperature, when it is determined that the second temperature is higher than the outside threshold temperature, determining whether a first temperature detected by the first temperature sensor is equal to or less than an inside threshold temperature, the first temperature sensor being disposed inside the space between the plurality of frames, the first temperature sensor being configured to detect the first temperature inside the space between the plurality of frames by outputting a signal corresponding to the first temperature, when it is determined that the first temperature is higher than the inside threshold temperature, determining whether duplex image formation is specified as an image forming mode, when it is determined that simplex image formation is specified, controlling the image forming assembly to perform image formation on a single side of a sheet while conveying the sheet at a first conveyance speed, when it is determined that duplex image formation is specified, controlling the image forming assembly to perform image formation on both sides of the sheet while conveying the sheet at a second conveyance speed, the second conveyance speed being lower than the first conveyance speed, and when it is determined that the second temperature is equal to or less than the outside threshold temperature or that the first temperature is equal to or less than the inside threshold temperature, controlling the image forming assembly to perform image formation on the sheet while conveying the sheet at the first conveyance speed.

According to aspects of the present disclosure, further provided is a non-transitory computer-readable medium storing computer-readable instructions that are executable by a processor coupled with an image forming apparatus, the image forming apparatus including a plurality of frames, an image forming assembly supported by the frames, a first temperature sensor, and a second temperature sensor, the instructions being configured to, when executed by the processor, cause the processor to determine whether a second temperature detected by the second temperature sensor is equal to or less than an outside threshold temperature, the second temperature sensor being disposed outside a space between the plurality of frames, the second temperature sensor being configured to detect the second temperature outside the space between the plurality of frames by outputting a signal corresponding to the second temperature, when determining that the second temperature is higher than the outside threshold temperature, determine whether a first temperature detected by the first temperature sensor is equal to or less than an inside threshold temperature, the first temperature sensor being disposed inside the space between the plurality of frames, the first temperature sensor being configured to detect the first temperature inside the space between the plurality of frames by outputting a signal corresponding to the first temperature, when determining that the first temperature is higher than the inside threshold temperature, determine whether duplex image formation is specified as an image forming mode, when determining that simplex image formation is specified, control the image forming assembly to perform image formation on a single side of a sheet while conveying the sheet at a first conveyance speed, when determining that duplex image formation is specified, control the image forming assembly to perform image formation on both sides of the sheet while conveying the sheet at a second conveyance speed, the second conveyance speed being lower than the first conveyance speed, and when determining that the second temperature is equal to or less than the outside threshold temperature or that the first temperature is equal to or less than the inside threshold temperature, control the image forming assembly to perform image formation on the sheet while conveying the sheet at the first conveyance speed.

BRIEF DESCRIPTION OF THE ACCOMPANYING DRAWINGS

FIG. 5 exemplifies a list of threshold temperatures in the illustrative embodiment according to one or more aspects of the present disclosure.

Figure 6:
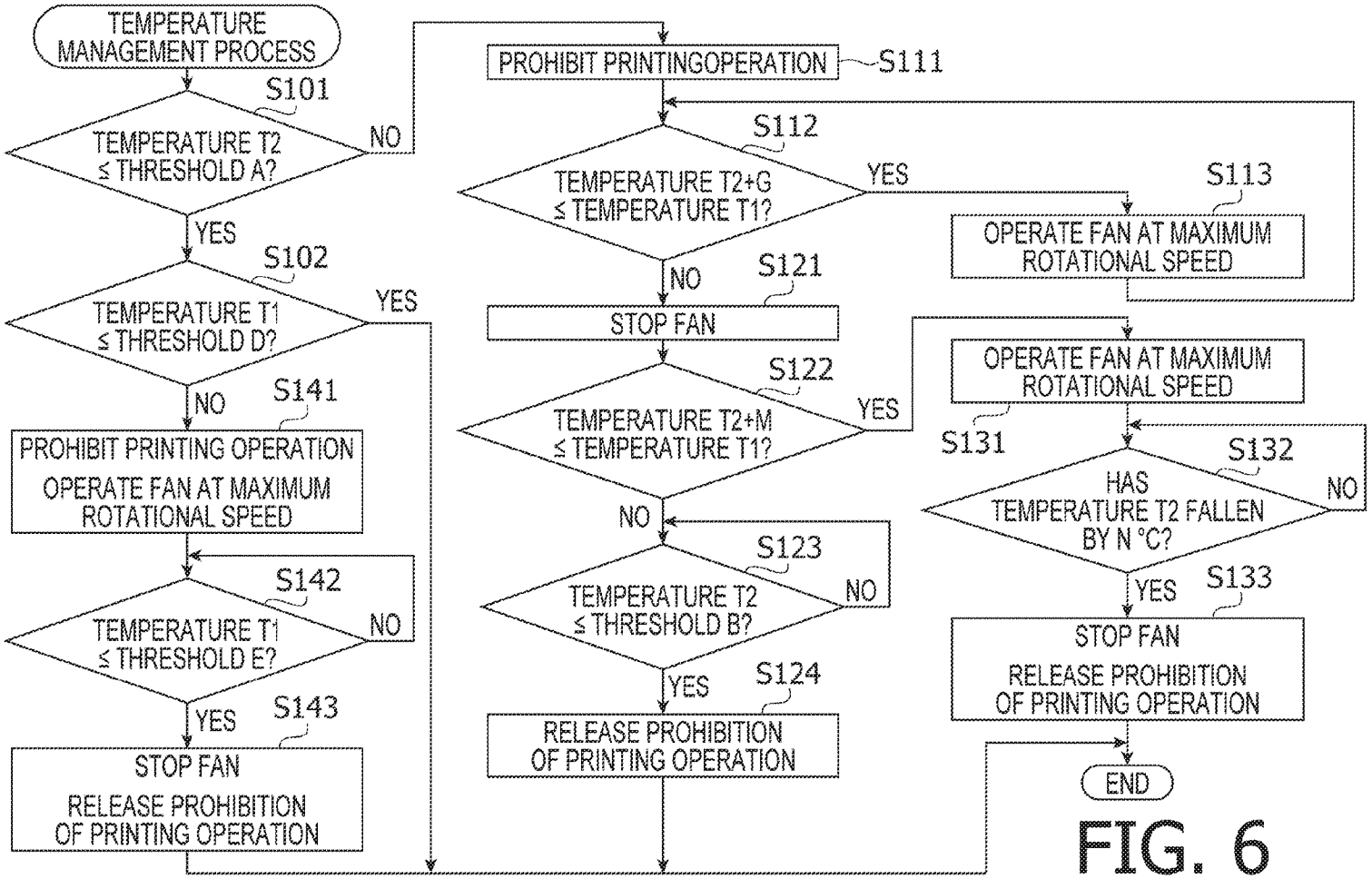

FIG. 6 is a flowchart showing a procedure of a temperature management process to be executed by the printer in the illustrative embodiment according to one or more aspects of the present disclosure.

Figure 7:
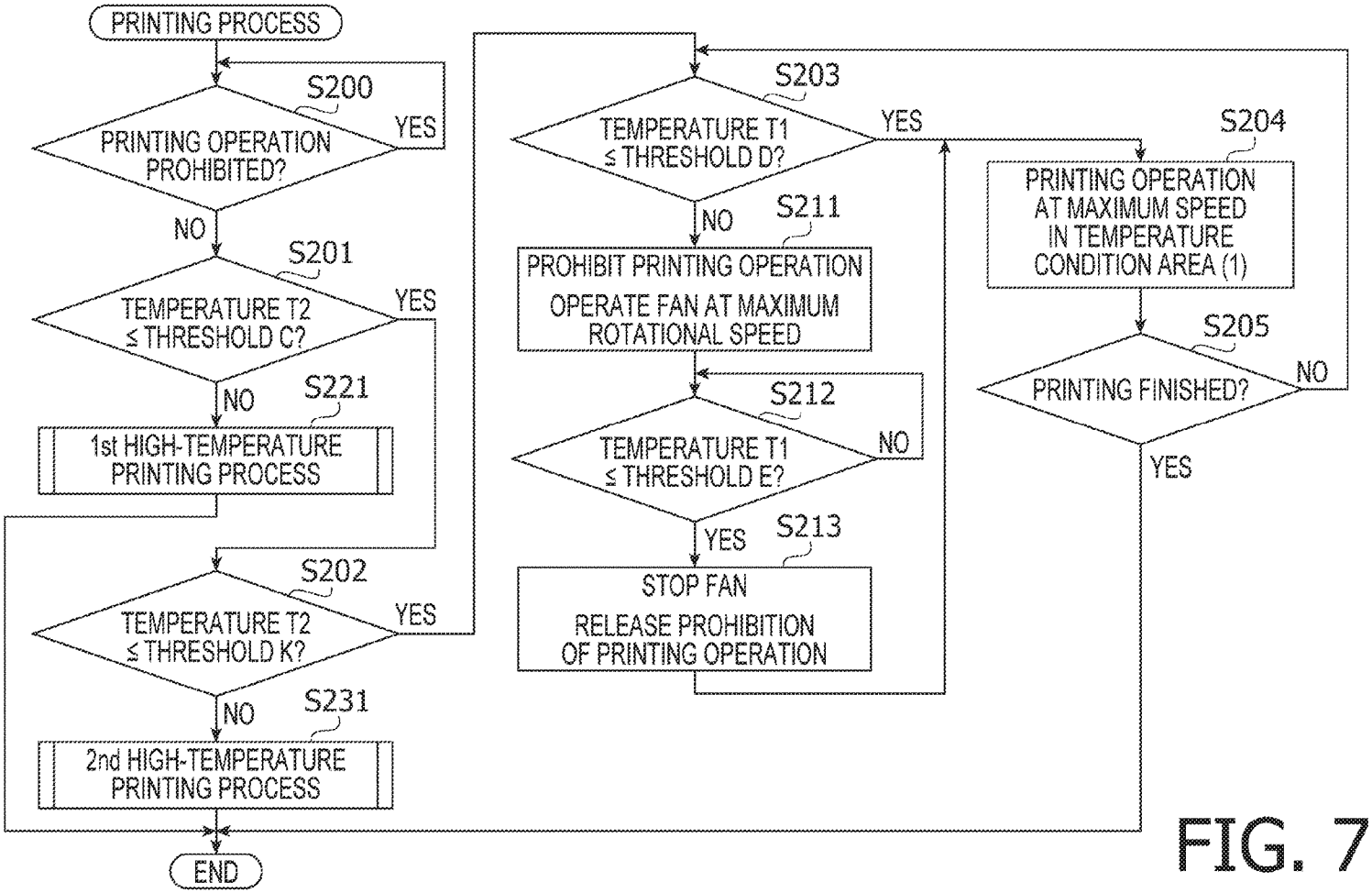

FIG. 7 is a flowchart showing a procedure of a printing process to be executed by the printer, in the illustrative embodiment according to one or more aspects of the present disclosure.

Figure 8:
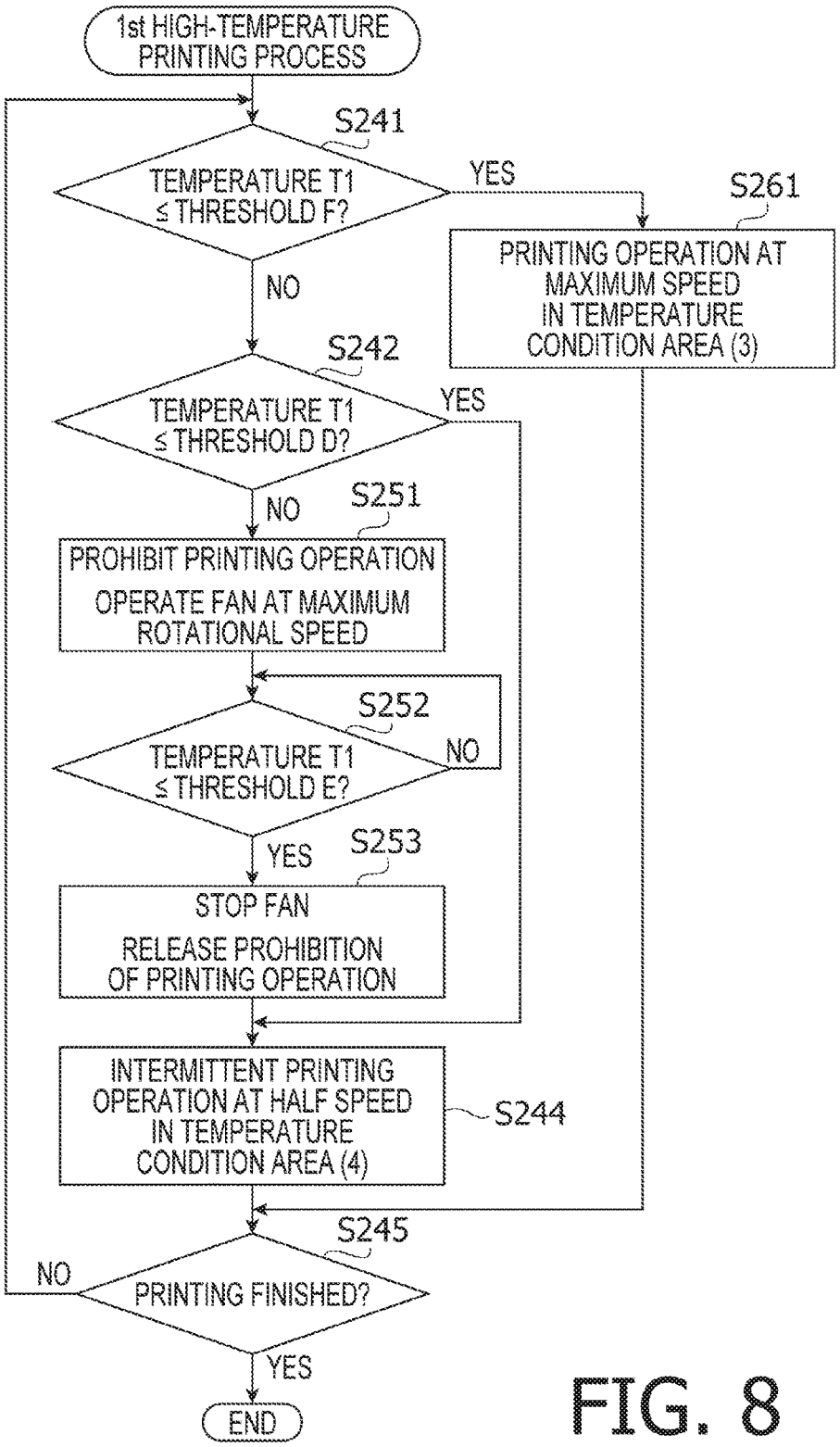

FIG. 8 is a flowchart showing a procedure of a first high-temperature printing process to be executed in the printing process by the printer, in the illustrative embodiment according to one or more aspects of the present disclosure.

Figure 9:
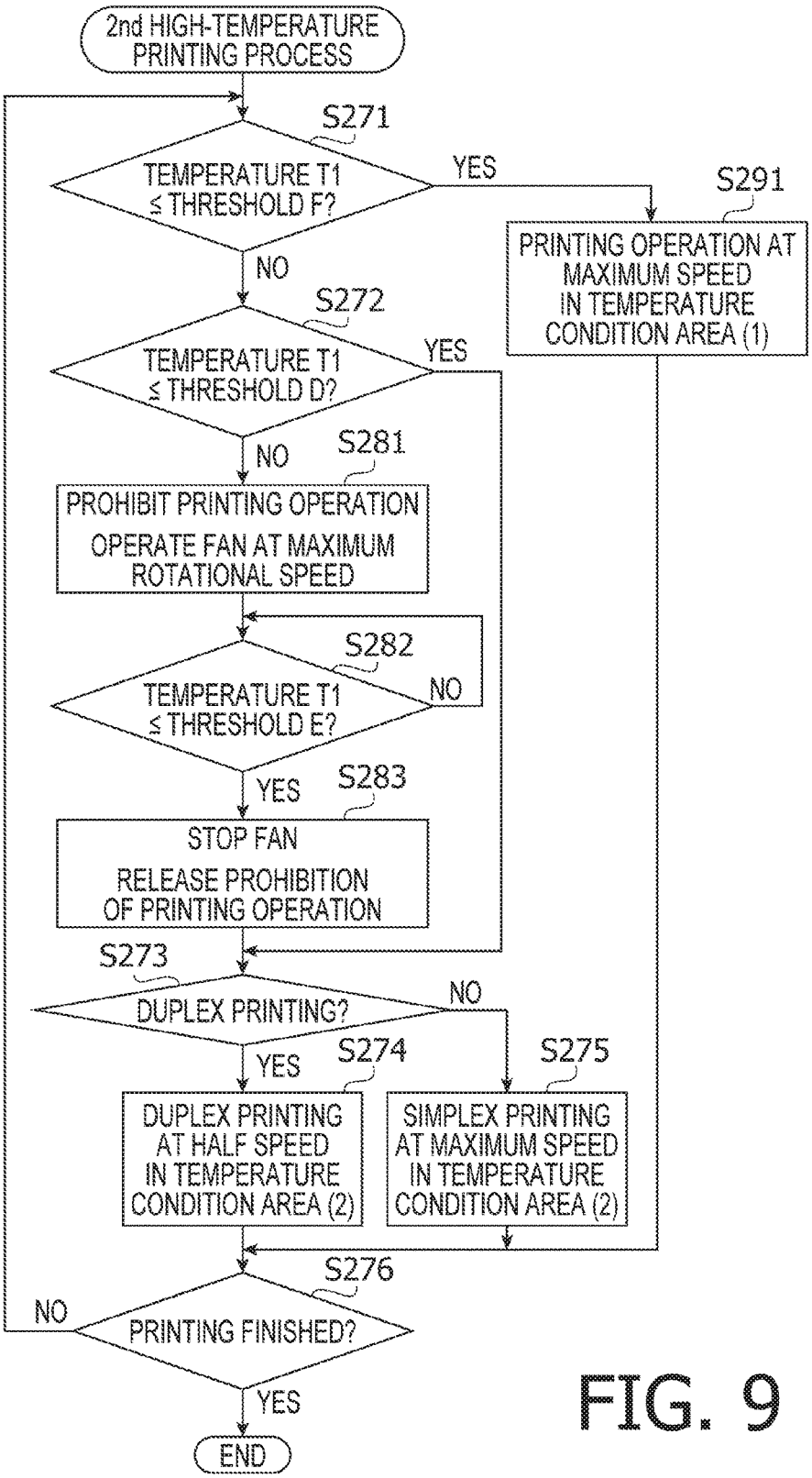

FIG. 9 is a flowchart showing a procedure of a second high-temperature printing process to be executed in the printing process by the printer, in the illustrative embodiment according to one or more aspects of the present disclosure.

Figure 10:
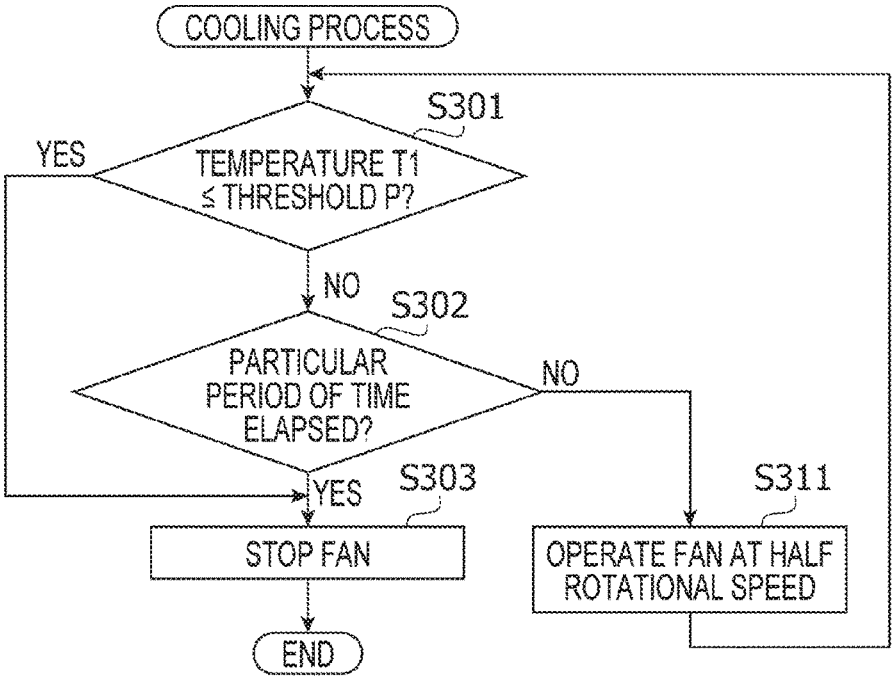

FIG. 10 is a flowchart showing a procedure of a cooling process to be executed by the printer, in the illustrative embodiment according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, an illustrative embodiment according to aspects of the present disclosure will be described with reference to the accompanying drawings. In the illustrative embodiment, aspects of the present disclosure are applied to a printer configured to perform electrophotographic image formation.

[Electric Configuration of Printer]

Figure 1:
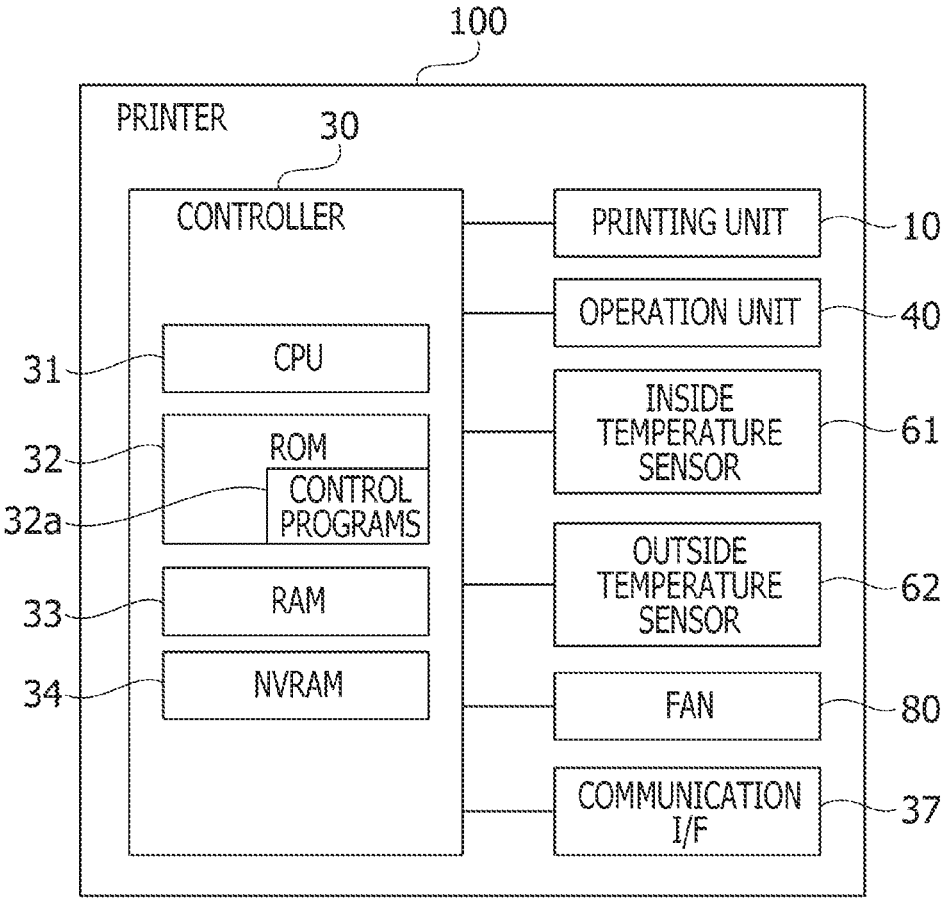
FIG. 1 is a block diagram schematically showing an electrical configuration of a printer in an illustrative embodiment according to one or more aspects of the present disclosure.

As shown in FIG. 1, a printer 100 of the illustrative embodiment includes a controller 30. The controller 30 includes a central processing unit (hereinafter referred to as "CPU") 31, a read-only memory (hereinafter referred to as "ROM") 32, a random access memory (hereinafter referred to as "RAM") 33, and a non-volatile random access memory (hereinafter referred to as "NVRAM") 34. Further, the printer 100 includes a printing unit 10, an operation unit 40, an inside temperature sensor 61, an outside temperature sensor 62, a fan 80, and a communication interface (hereinafter, which may be referred to as "communication IF") 37. The operation unit 40 is configured to accept user input operations. The inside temperature sensor 61 and the outside temperature sensor 62 are configured to output signals corresponding to a temperature inside the printer 100 and a temperature outside the printer 100, respectively. The fan 80 is configured to generate an air current inside the printer 100. The communication interface 37 is configured to communicate with external devices. The aforementioned elements included in the printer 100 are controlled by the CPU 31. It is noted that the "controller 30" shown in FIG. 1 is a generic name of an aggregate of hardware elements (e.g., the CPU 31, the ROM 32, the RAM 33, and the NVRAM 34) used for controlling the printer 100, and may not necessarily represent a single hardware element actually existing in the printer 100.

The ROM 32 stores therein control programs 32*a* as firmware for controlling the printer 100, settings, and initial values. The RAM 33 and the NVRAM 34 are used as work areas into which the control programs 32*a* are loaded, or as storage areas in which data is temporarily stored.

According to the control programs 32*a* read out from the ROM 32 and/or signals from various sensors, the CPU 31 controls each of elements included in the printer 100 while storing processing results into at least one of the RAM 33 and the NVRAM 34. The CPU 31 is an example of a controller. The controller 30 may be an example of the controller.

The inside temperature sensor 61 and the outside temperature sensor 62 are hardware elements configured to detect temperature. For instance, as the inside temperature sensor 61 and the outside temperature sensor 62, thermistors, thermocouples, or temperature measuring resistors may be used. The CPU 31 acquires output signals from each of the temperature sensors 61 and 62 in a periodic manner (e.g., every one millisecond during a printing operation, and every five milliseconds while waiting in a ready state). Further, the CPU 31 stores, into the RAM 33, temperatures corresponding to the acquired output signals. The inside temperature sensor 61 is an example of a first temperature sensor. The outside temperature sensor 62 is an example of a second temperature sensor.

The fan 80 is a hardware element configured to turn blades thereof and generate an air current. For example, a sirocco fan may be used as the fan 80. The fan 80 is used for cooling the inside of the printer 100.

The communication interface 37 is a hardware element configured to communicate with external devices. The communication interface 37 may include a wired LAN interface, a wireless LAN interface, a serial communication interface, a parallel communication interface, and a facsimile interface. The printer 100 is allowed to receive a print job for causing the printing unit 10 to perform a printing operation, from an external device via the communication interface 37.

The operation unit 40 includes various buttons for accepting user input operations, and a touch panel for displaying messages and settings. The buttons may include an execution button for causing the printing unit 10 to perform a printing operation, and a cancel button for accepting an instruction to cancel a printing operation. Further, the operation unit 40 is configured to accept user input operations of touching the touch panel.

[Internal Configuration of Printer]

Figure 2:
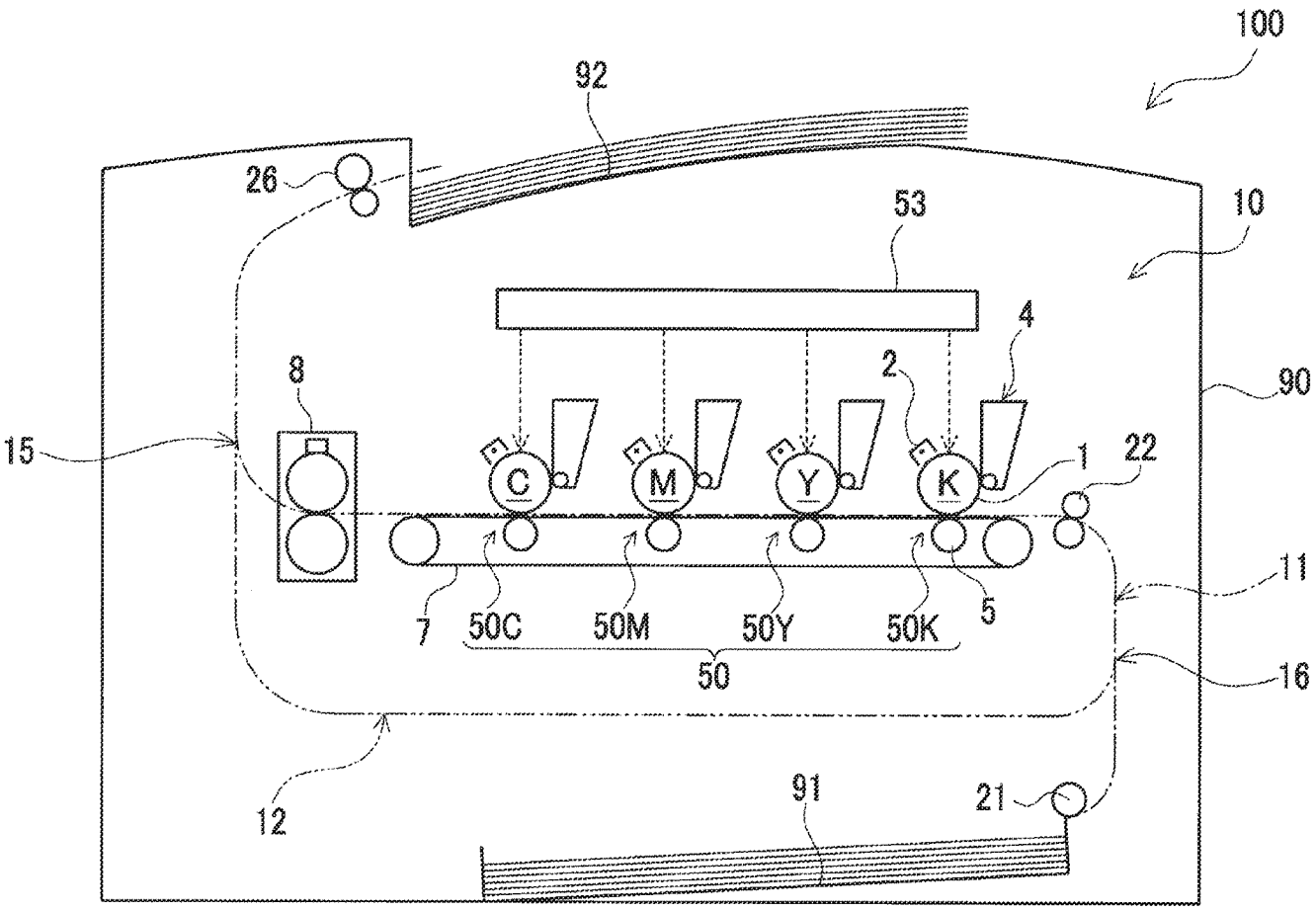
FIG. 2 is a cross-sectional side view schematically showing an internal configuration of the printer in the illustrative embodiment according to one or more aspects of the present disclosure.
Figure 3:
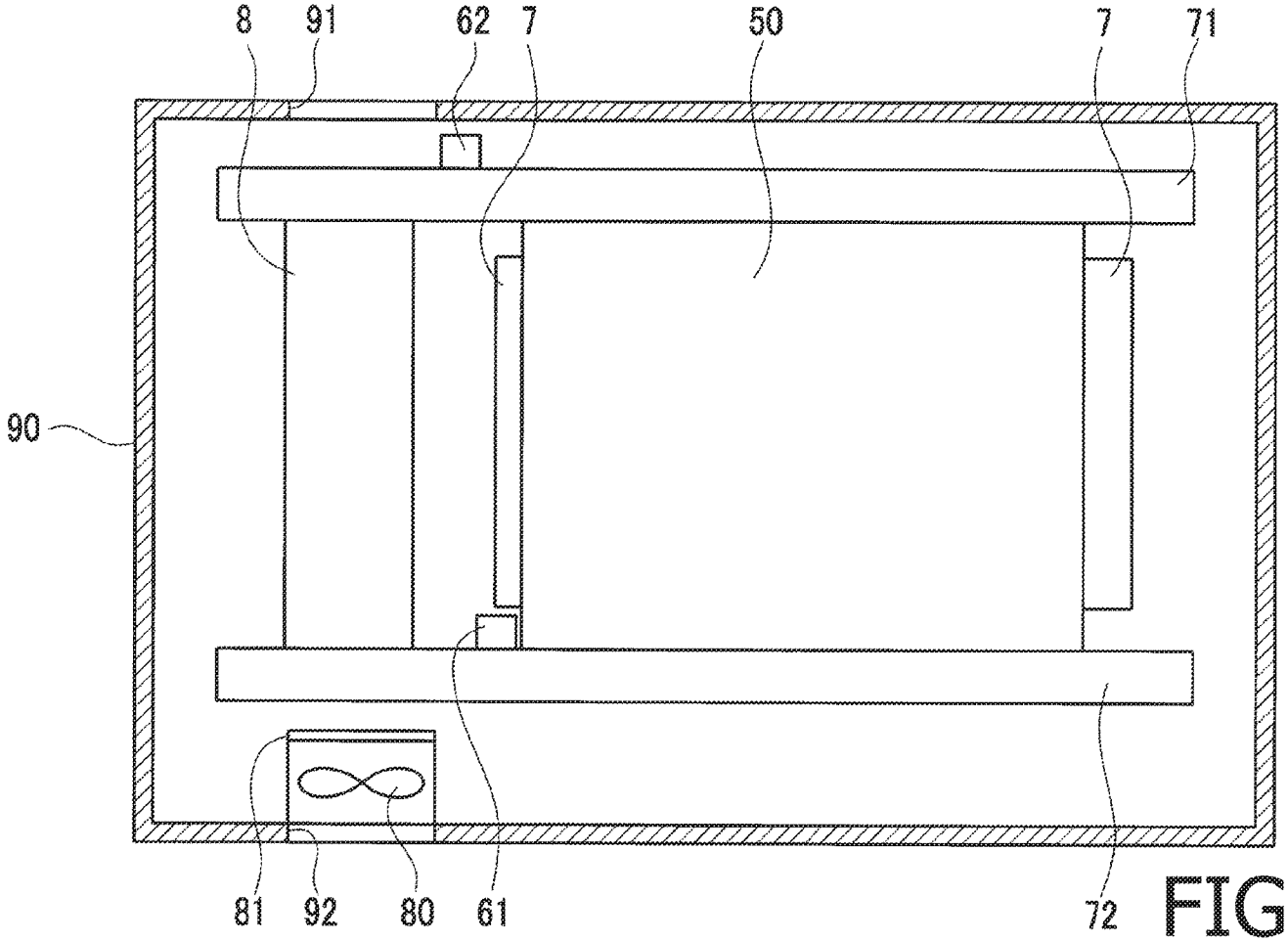
FIG. 3 is a cross-sectional plane view schematically showing the internal configuration of the printer in the illustrative embodiment according to one or more aspects of the present disclosure.

Subsequently, an internal configuration of the printer 100 will be described with reference to FIGS. 2 and 3. FIG. 2 is a cross-sectional side view schematically showing a configuration inside a housing 90 of the printer 100. FIG. 3 is a cross-sectional plane view schematically showing the configuration inside the housing 90 of the printer 100.

As shown in FIG. 2, the printing unit 10 is disposed inside the housing 90 of the printer 100. The printing unit 10 is configured to electrophotographically form a toner image. The printing unit 10 includes process units 50, an exposure unit 53, a fuser assembly 8, a feed tray 91, a discharge tray, and a conveyance belt 7. Each process unit 50 is configured to transfer the toner image onto a sheet. The exposure unit 53 is configured to emit light to the process units 50. The fuser assembly 8 is configured to fix the toner images transferred on the sheet. The conveyance belt 7 is configured to convey the sheet to respective transfer positions of the process units 50. The feed tray 91 is configured to support sheets placed without any image transferred thereon. The discharge tray 92 is configured to support sheets discharged with images transferred thereon. Each process unit 50 is an example of an image forming assembly. The printing unit 10 may be an example of the image forming assembly. The fuser assembly 8 is an example of a fuser assembly.

Further, inside the printer 100, there is a substantially S-shaped printing path 11 (indicated by an alternate long and short dash line in FIG. 2). Through the printing path 11, a sheet set on the feed tray 91 (disposed at a lower portion of the printer 100) is guided to the discharge tray 92 (disposed on an upper face of the printer 100) via a pickup roller 21, registration rollers 22, the process units 50, the fuser assembly 8, and discharge rollers 26.

The process units 50 are configured to form a color image. In the illustrative embodiment, as shown in FIG. 2, four process units 50 corresponding to four colors, i.e., cyan (C), magenta (M), yellow (Y), and black (K) are arranged in parallel. More specifically, the printer 100 includes a process unit 50C configured to form an image of cyan (C), a process unit 50M configured to form an image of magenta (M), a process unit 50Y configured to form an image of yellow (Y), and a process unit 50K configured to form an image of black (K). The process units 50C, 50M, 50Y, and 50K are arranged at regular intervals in the aforementioned order from a downstream side in a sheet conveyance direction. Nonetheless, the process units 50C, 50M, 50Y, and 50K may be arranged in a different order.

The process unit 50K includes a drum-shaped photoconductive body 1, a charger 2, a development unit 4, and a transfer unit 5. The charger 2 is configured to evenly charge a surface of the photoconductive body 1. The development unit 4 is configured to develop an electrostatic latent image formed on the photoconductive body 1 by supplying toner to the electrostatic latent image. The transfer unit 5 is configured to transfer a toner image formed on the photoconductive body 1 onto a sheet or the conveyance belt 7. The photoconductive body 1 and the transfer unit 5 are disposed in contact with the conveyance belt 7. The photoconductive body 1 is disposed to face the transfer unit 5 across the conveyance belt 7. Each of the other process units 50C, 50M, and 50Y is configured substantially in the same manner as exemplified above for the process unit 50K.

In each of the process units 50C, 50M, 50Y, and 50K, the surface of the photoconductive body 1 is evenly charged by the charger 2. After that, the surface of the photoconductive body 1 is exposed to light emitted by the exposure unit 53, and an electrostatic latent image corresponding to an intended image is formed on the photoconductive body 1. Subsequently, toner is supplied to the photoconductive body 1 from the development unit 53. Thereby, the electrostatic latent image on the photoconductive body 1 is visualized as a toner image.

The printer 100 picks up the sheets placed on the feed tray on a sheet-by-sheet basis, and feeds the picked-up sheet onto the conveyance belt 7. Thereafter, the toner image formed by each process unit 50 is transferred onto the sheet. At this time, in color printing, the process units 50C, 50M, 50Y, and 50K form respective toner images. Then, the toner images are superimposed on the sheet. On the other hand, in monochrome printing, the toner image is formed only by the process unit 50K and transferred onto the sheet. After that, the sheet with the one or more toner images transferred thereon is conveyed to the fuser assembly 8, and the one or more toner images are thermally fixed onto the sheet. Then, the sheet with the one or more toner images fixed thereon is discharged onto the discharge tray 92.

Further, the printer 100 includes a conveyance mechanism for duplex printing. A conveyance path 12 (indicated by an alternate long and two short dashes line in FIG. 2) is configured to re-convey the sheet passed through the fuser assembly 8 to the process units 50 in such a manner that the process units 50 perform image formation on a second surface of a sheet with an image formed on a first surface thereof. The conveyance path 12 is an example of a re-conveyance guide.

At a bifurcation 15, the conveyance path 12 diverges from the printing path 11. The bifurcation 15 is positioned downstream of the fuser assembly 8 and upstream of the discharge rollers 26 in the sheet conveyance direction. The conveyance path 12 extends from the bifurcation 15, passes between each process unit 50 and the feed tray 91, and joins the printing path 11 at a junction 16. The junction 16 is positioned upstream of the registration rollers 22 on the printing path 11.

Specifically, in the duplex printing, the printer 100 reverses the first and second surfaces of a sheet in accordance with the following procedure. Firstly, the printer 100 conveys the sheet with the image formed on the first surface thereof, to the discharge rollers 26 through the printing path 11. After a trailing end of the sheet passes through the bifurcation 15, the printer 100 stops the conveyance of the sheet in a state where the discharge rollers 26 are pinching the sheet therebetween. Thereafter, the printer 100 changes a rotational direction of each discharge roller 26 to reverse the sheet conveyance direction, and conveys the sheet to the conveyance path 12 via the bifurcation 15. Then, in a position upstream of the process units 50 on the printing path 11, the printer 100 conveys the sheet back to the printing path 11 via the junction 16. Thereby, the printer 100 reverses the first and second surfaces of the sheet so as to form an image on the second surface.

Further, as shown in FIG. 3, there are metal frames 71 and 72 provided inside the housing 90 of the printer 100. The fuser assembly 8, the process units 50, the conveyance belt 7, and conveyance rollers are disposed between the frame 71 and the frame 72, and are supported by at least one of the frames 71 and 72. Further, the housing 90 has an inlet port 91 and an exhaust port 92. As shown in FIG. 3, the inlet port 91 is formed at an end portion of the housing 90 in a longitudinal direction of the fuser assembly 8. The exhaust port 92 is formed at the other end portion of the housing 90 in the longitudinal direction of the fuser assembly 8.

The fan 80 is disposed between the frame 72 and the exhaust port 92 of the housing 90. The fan 80 is configured to, when rotated, generate an air current from the inlet port 91 to the exhaust port 92 inside the housing 90. Thereby, heat generated, e.g., from the fuser assembly 8 and/or the process units 50 is discharged out of the housing 90, and the inside of the printer 100 is cooled. A dust-proof filter 81 is attached to the fan 80.

The inside temperature sensor 61 is supported by the frame 72 and disposed between the frame 71 and the frame 72. Namely, the inside temperature sensor 61 outputs a signal corresponding to a temperature in a space between the frame 71 and the frame 72. Therefore, the CPU 31 acquires the temperature in the space between the frame 71 and the frame 72, based on the output signal from the inside temperature sensor 61.

The outside temperature sensor 62 is supported by the frame 71 and disposed between the frame 71 and the housing 90. Namely, the outside temperature sensor 62 outputs a signal corresponding to a temperature in a space between the frame 71 and the housing 90. Therefore, the CPU 31 acquires the temperature in the space between the frame 71 and the housing 90, based on the output signal from the outside temperature sensor 62. It is noted that the outside temperature sensor 62 is disposed adjacent to the inlet port 91. Thus, the temperature acquired based on the output signals from the outside temperature sensor 62 is substantially regarded as temperature outside the housing 90.

It is noted that the inside temperature sensor 61 only needs to be disposed between the frame 71 and the frame 72. For instance, the inside temperature sensor 61 may be supported by the frame 71. Further, the inside temperature sensor 61 may not be supported by the frame 71 or the frame 72. For instance, the inside temperature sensor 61 may be supported by the process units 50. Further, the outside temperature sensor 62 only needs to be disposed outside a region between the frame 71 and the frame 72. For instance, the outside temperature sensor 62 may be supported by the frame 72 or the housing 90.

[Printing Modes of Printer]

Subsequently, an explanation will be provided of printing modes of the printer 100 that are different depending on temperature. As the temperature (hereinafter referred to as the "inside temperature") inside the printer 100 is higher, malfunctions are more likely to occur. Therefore, in the illustrative embodiment, when the inside temperature exceeds a particular temperature, the printer 100 performs a cooling operation of turning off a heater of the fuser assembly 8 and a driving motor of the process units 50 and operating the fan 80 to cool the inside of the printer 100. The printer 100 is not allowed to perform a printing operation during execution of the cooling operation. Therefore, in order to delay the inside temperature to reach the particular temperature as a condition required for execution of the cooling operation, the printer 100 performs a printing operation for suppressing a rise in the inside temperature.

The printer 100 determines whether to perform the cooling operation and the printing operation for suppressing a rise in the inside temperature, based on output signals from the inside temperature sensor 61 and the outside temperature sensor 62. In the following description, a temperature acquired based on the output signal from the inside temperature sensor 61 may be referred to as an "inside temperature T1." Further, a temperature acquired based on the output signal from the outside temperature sensor 62 may be referred to as an "outside temperature T2."

Figure 4:
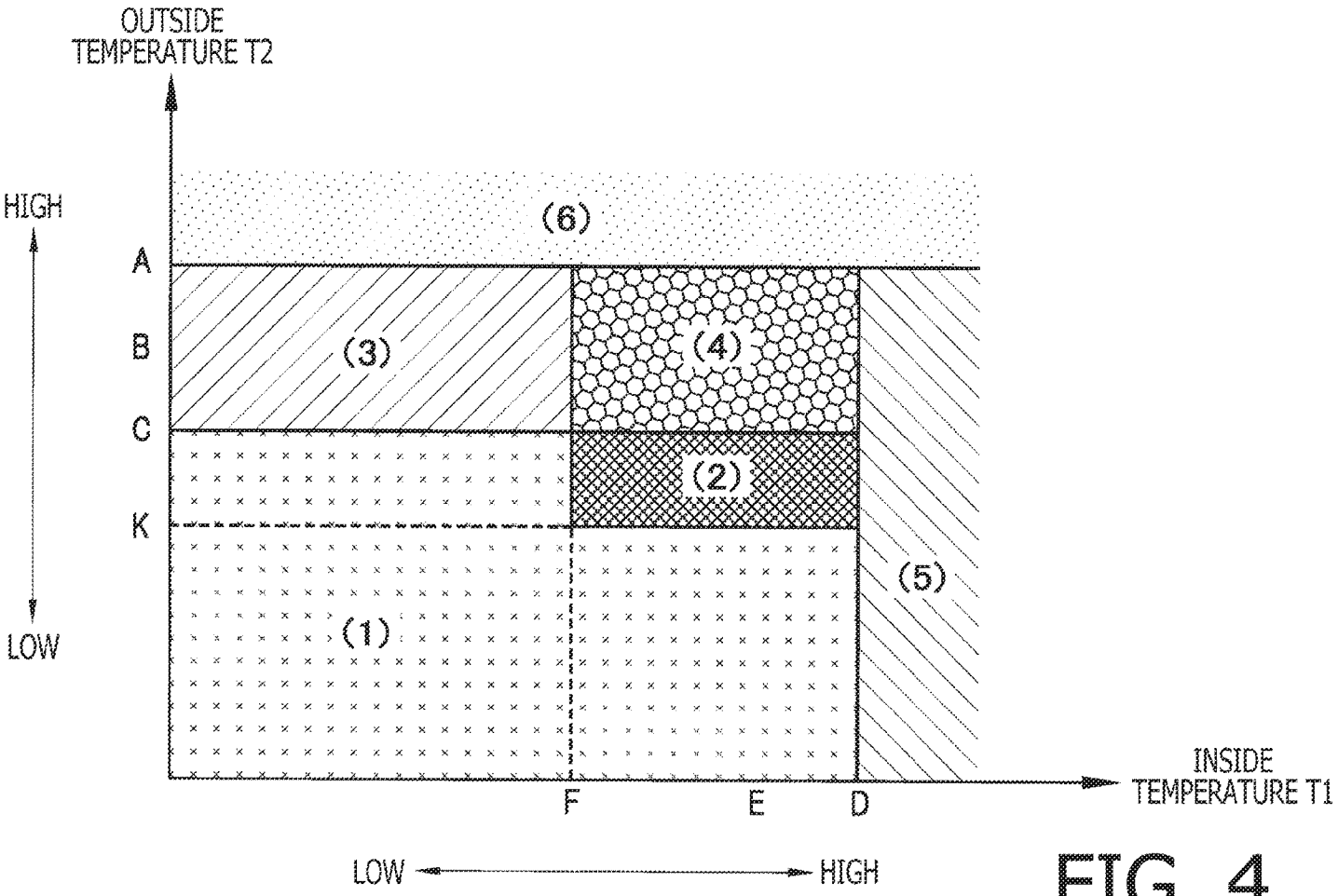
FIG. 4 shows temperature condition areas for the printer, each of which is defined by a combination of an inside temperature T1 (corresponding to a temperature inside the printer) and an outside temperature T2 (corresponding to a temperature outside the printer), in the illustrative embodiment according to one or more aspects of the present disclosure.

FIG. 4 shows temperature condition areas for the printer 100, each of which is defined by a combination of the inside temperature T1 and the outside temperature T2. In FIG. 4, "A" represents a threshold A to determine whether the outside temperature T2 satisfies a condition for starting the cooling operation. In FIG. 4, "B" represents a threshold B to determine whether the outside temperature T2 satisfies a condition for stopping the cooling operation. In FIG. 4, "C" represents a threshold C to determine whether the outside temperature T2 satisfies a condition for performing a first special printing operation to suppress a rise in temperature. In FIG. 4, "D" represents a threshold D to determine whether the inside temperature T1 satisfies a condition for starting the cooling operation. In FIG. 4, "E" represents a threshold E to determine whether the inside temperature T1 satisfies a condition for stopping the cooling operation. In FIG. 4, "F" represents a threshold F to determine whether the inside temperature T1 satisfies a condition for performing the first special printing operation or a second special printing operation to suppress a rise in temperature. In FIG. 4, "K" represents a threshold K to determine whether the outside temperature T2 satisfies a condition for performing the second special printing operation to suppress a rise in temperature. The first special printing operation and the second special printing operation will be described later. The large-small relationships between the above thresholds are shown as follows:

the threshold A > the threshold B > the threshold C > the threshold K, and the threshold D > the threshold E > the threshold F.

The threshold A is an example of an outside limit temperature. The threshold B is an example of an outside permissible temperature. The threshold C is an example of a second outside threshold temperature. The threshold D is an example of an inside limit temperature. The threshold E is an example of an inside permissible temperature. The threshold F is an example of an inside threshold temperature. The threshold K is an example of an outside threshold temperature.

FIG. 5 exemplifies respective specific values of the thresholds shown in FIG. 4. Each threshold may be stored in at least one of the ROM 32 and the NVRAM 34. Each threshold may be a fixed value or a value variable by a user input. In the illustrative embodiment, each threshold is a fixed value stored in the ROM 32.

When a temperature condition defined by a combination of the inside temperature T1 and the outside temperature T2 is within an area (1) shown in FIG. 4, the printer 100 is less likely to cause malfunctions due to temperature. Therefore, in the area (1), the printer 100 performs a printing operation at a maximum speed (e.g., the printer 100 may perform a printing operation while conveying sheets at a maximum conveyance speed). It is noted that the area (1) includes an area where the inside temperature T1 is equal to or less than the threshold D, and the outside temperature T2 is equal to or less than the threshold K. Further, the area (1) includes an area where the inside temperature T1 is equal to or less than the threshold F, and the outside temperature T2 is equal to or less than the threshold C. Additionally, in an area (3) where the inside temperature T1 is equal to or less than the threshold F, and the outside temperature T2 is higher than the threshold C and equal to or less than the threshold A, the printer 100 is less likely to cause malfunctions due to temperature. Therefore, in the area (3) as well, the printer 100 performs a printing operation at the maximum speed. Namely, in the areas (1) and (3), since there is a low possibility that the printer 100 causes malfunctions due to temperature, the printer 100 performs a regular printing operation.

In an area (4) shown in FIG. 4, the printer 100 performs an intermittent printing operation at a half speed (e.g., the printer 100 may perform an intermittent printing operation while conveying a sheet at a half conveyance speed), as the first special printing operation. It is noted that the area (4) is an area where the inside temperature T1 is more than the threshold F and equal to or less than the threshold D, and the outside temperature T2 is higher than the threshold C and equal to or less than the threshold A. The half speed represents a speed half as high as the maximum speed. Nonetheless, the half speed may not necessarily be accurately half as high as the maximum speed. The half speed may be a speed lower than the maximum speed. Further, in the intermittent printing operation, the printer 100 does not perform a printing operation for a particular number of seconds after continuously printing a particular number of sheets. Since the printer 100 does not perform a printing operation for a particular period of time, it is possible to suppress a rise in the inside temperature T1. In the illustrative embodiment, for instance, the printer 100 does not perform a printing operation for 60 seconds after continuously printing 10 sheets. When the inside temperature T1 and the outside temperature T2 are close to respective temperatures at which the cooling operation is needed, it is hard for heat accumulated inside the printer 100 to be discharged outside. Therefore, when the printer 100 performs a printing operation at the maximum speed, the inside temperature T1 is more likely to soon reach a cooling-requiring temperature above which the cooling operation is required. Thus, it is possible to print a larger number of sheets by performing intermittent printing at a low speed to suppress a rise in the inside temperature T1 and delay the inside temperature T1 to reach the cooling-requiring temperature.

In an area (2) shown in FIG. 4, when simplex printing is specified, the printer 100 performs the simplex printing at the maximum speed as the second special printing operation. Meanwhile, when duplex printing is specified, the printer 100 performs the duplex printing at the half speed as the second special printing operation. It is noted that the area (2) is an area where the inside temperature T1 is higher than the threshold F and equal to or less than the threshold D, and the outside temperature T2 is higher than the threshold K and equal to or less than the threshold C. In the area (2), the outside temperature T2 is not so high. Nonetheless, when the printer 100 performs the duplex printing, the inside temperature T1 might soon reach the cooling-requiring temperature. Specifically, in the duplex printing, since a heated sheet is conveyed inside the printer 100 for a long period of time, the inside temperature T1 is likely to rise more easily. Therefore, when the duplex printing is specified, it is possible to print a larger number of sheets by performing the duplex printing at the half speed so as to suppress a rise in the inside temperature T1 and delay the inside temperature T1 to reach the cooling-requiring temperature.

In an area (5) shown in FIG. 4, since the printer 100 is more likely to cause malfunctions due to temperature, the printer 100 turned off the driving motor for the process units 50 and the heater of the fuser assembly 8. Further, the printer 100 operates the fan 80 at a maximum rotational speed. It is noted that the area (5) is an area where the inside temperature T1 is higher than the threshold D, and the outside temperature T2 is equal to or less than the threshold A. Namely, when the inside temperature T1 exceeds the cooling-requiring temperature, the printer 100 performs, as the cooling operation, an operation of rotating the fan 80 to cool the inside of the printer 100 while prohibiting a printing operation that would cause heat generation.

In an area (6) in FIG. 4 where the outside temperature T2 is higher than the threshold A, when the inside temperature T1 is higher than the outside temperature T2, the printer 100 performs the cooling operation. Then, when the inside temperature T1 becomes substantially the same as the outside temperature T2, heat exchange cannot be expected between air outside the printer 100 and air inside the printer 100. Hence, the printer 100 stops the fan 80. Thereafter, when the outside temperature T2 becomes equal to or less than the threshold B, the printer 100 releases the prohibition of a printing operation.

Further, in the area (6) shown in FIG. 4, when the outside temperature T2 is much higher than the inside temperature T1, the printer 100 performs the cooling operation. The inside temperature sensor 61 is disposed in a region surrounded by the frames 71 and 72. The inside temperature T1 is usually higher than the outside temperature T2. Nonetheless, there may be a rare case where only an area around the outside temperature sensor 62 is locally warmed by external factors such as the afternoon sun, and therefore the outside temperature sensor 62 outputs signals corresponding to a temperature higher than an actual outside air temperature. Hence, the printer 100 operates the fan 80 to circulate air around the outside temperature sensor 62. Then, after the outside temperature T2 is made lower to some extent, the printer 100 stops the fan 80 and releases the prohibition of a printing operation. In this case, when the inside temperature T1 is higher than the threshold F, the printer 100 performs the first printing operation in the same manner as executed under the temperature condition in the area (4) shown in FIG. 4. When the inside temperature T1 is not higher than the threshold F, the printer 100 performs a printing operation at the maximum speed in the same manner as executed under the temperature condition in the area (3) shown in FIG. 4.

[Temperature Management Process]

Subsequently, referring to FIG. 6, an explanation will be provided of a temperature management process as one of specific controls for the aforementioned printing modes. In the temperature management process, the printer 100 performs the cooling operation in accordance with the temperature condition defined by a combination of the inside temperature T1 and the outside temperature T2. The temperature management process is performed by the CPU 31 of the printer 100 (more specifically, by the CPU 31 executing one or more control programs 32*a* stored in the ROM 32) in response to the printer 100 being turned on or the printer 100 being restored into a ready state from a power-saving state. It is noted that, in the ready state, the printer 100 is allowed to perform a printing operation. Meanwhile, in the power-saving state, the printer 100 is not allowed to perform a printing operation. The temperature management process may be performed periodically (e.g., every five minutes) on condition that the printer 100 is in the ready state.

In the temperature management process, firstly, the CPU 31 determines whether the outside temperature T2 is equal to or less than the threshold A (S101). The CPU 31 periodically stores into the RAM 33 the outside temperature T2 detected by the outside temperature sensor 62. Thus, in S101, the CPU 31 is allowed to compare the outside temperature T2 with the threshold A after reading out the outside temperature T2 stored in the RAM 33. It is noted that, in the following description, before using or referring to the outside temperature T2, the CPU 31 may read out the outside temperature T2 from the RAM 33. Likewise, before using or referring to the inside temperature T1, the CPU 31 may read out the inside temperature T1 from the RAM 33.

When determining that the outside temperature T2 is equal to or less than the threshold A (S101: Yes), the CPU 31 determines whether the inside temperature T1 is equal to or less than the threshold D (S102). When determining that the inside temperature T1 is equal to or less than the threshold D (S102: Yes), the CPU 31 terminates the temperature management process without performing the cooling operation.

Meanwhile, when determining that the outside temperature T2 is higher than the threshold A (S101: No), the CPU 31 prohibits a printing operation that causes heat generation, e.g., through driving the motor and heating the heater of the fuser assembly 8 (S111). For instance, the CPU 31 stores into the NVRAM 34 a prohibition flag indicating whether a printing operation is prohibited, sets the prohibition flag ON in S111. While the prohibition flag is set ON, the CPU 31 refrains from issuing a print instruction to the printing unit 10.

After S111, the CPU 31 determines whether the inside temperature T1 is equal to or more than a temperature obtained by adding G ° C. to the outside temperature T2 (S112). The value G is a regulation value for taking into account variations in detection accuracy of each of the temperature sensors 61 and 62. In the illustrative embodiment, the value G is set to 2° C. Nonetheless, the value G may be set to 0° C. The value G is an example of a regulation value. When determining that the inside temperature T1 is equal to or more than the temperature obtained by adding G ° C. to the outside temperature T2 (S112: Yes), the CPU 31 operates the fan 80 at the maximum rotational speed (S113). The step S113 is an operation to be executed under the temperature condition in the area (6) shown in FIG. 4. After 5112, the CPU 31 waits until the inside temperature T1 becomes lower than the temperature obtained by adding G ° C. to the outside temperature T2. Thereby, heat exchange is performed between the inside and the outside of the printer 100, and the inside temperature T1 is lowered.

When determining that the inside temperature T1 is lower than the temperature obtained by adding G ° C. to the outside temperature T2 (S112: No), the CPU 31 stops the fan 80 (S121). It is noted that when the inside temperature T1 is lower than the temperature obtained by adding G ° C. to the outside temperature T2 from the beginning, and the CPU 31 has not operated the fan 80 in S113, the CPU 31 skips S121. After that, the CPU 31 determines whether the inside temperature T1 is equal to or less than a temperature obtained by adding M ° C. to the outside temperature T2 (S122). The value M is an adjustment value for taking into account variations in the detection accuracy of each of the temperature sensors 61 and 62. The value M may be the same as the value G, or may be different from the value G. In the illustrative embodiment, the value M is the same as the value G. The value M is an example of an adjustment value.

When determining that the inside temperature T1 is higher than the temperature obtained by adding M ° C. to the outside temperature T2 (S122: No), the CPU 31 determines whether the outside temperature T2 is equal to or less than the threshold B (S123). Then, when determining that the outside temperature T2 is not equal to or less than the threshold B (S123: No), the CPU 31 waits until the outside temperature T2 becomes equal to or less than the threshold B. Namely, when the outside temperature T2 is high, even though the fan 80 is operated such that air around the printer 100 is introduced into the printer 100, a cooling effect thereof cannot be expected. Therefore, the CPU 31 waits until the outside temperature T2 falls, without operating the fan 80. This waiting operation is an operation to be executed under the temperature condition in the area (6) shown in FIG. 4.

When determining that the outside temperature T2 is equal to or less than the threshold B (S123: Yes), the CPU 31 releases the prohibition of a printing operation (S124). For instance, the CPU 31 sets OFF the prohibition flag set ON in S111, and does not prohibit a printing operation while the prohibition flag is set OFF. After S124, the CPU 31 terminates the temperature management process.

When determining that the inside temperature T1 is equal to or less than the temperature obtained by adding M ° C. to the outside temperature T2 (S122: Yes), the CPU 31 operates the fan 80 at the maximum rotational speed (S131). The step S131 is an operation to be executed under the temperature condition in the area (6) shown in FIG. 4. Thereby, when an area around the outside temperature sensor 62 is locally warmed by external factors such as the afternoon sun, the outside temperature T2 is lowered. After S131, the CPU 31 determines whether the outside temperature T2 has fallen by N ° C. (S132). The value N is a value for determining whether the outside temperature T2 has returned to a normal temperature. In the illustrative embodiment, the value N is 2° C. The value N is an example of a predetermined temperature value.

When determining that the outside temperature T2 has not fallen by N ° C. (S132: No), the CPU 31 waits until the outside temperature T2 falls by N ° C. When determining that the outside temperature T2 has fallen by N ° C. (S132: Yes), the CPU 31 stops the fan 80 and releases the prohibition of a printing operation (S133). After S133, the CPU 31 terminates the temperature management process.

Meanwhile, when determining that the inside temperature T1 is higher than the threshold D (S102: No), the CPU 31 prohibits a printing operation and operates the fan 80 at the maximum rotational speed (S141). The step S141 is an operation to be executed under the temperature condition in the area (5) shown in FIG. 4. Thereby, heat exchange is performed between the inside and the outside of the printer 100, and the inside temperature T1 is lowered. After S141, the CPU 31 determines whether the inside temperature T1 is equal to or less than the threshold E (S142). When determining that the inside temperature T1 is higher than the threshold E (S142: No), the CPU 31 waits until the inside temperature T1 becomes equal to or less than the threshold E. When determining that the inside temperature T1 is equal to or less than the threshold E (S142: Yes), the CPU 31 stops the fan 80 and releases the prohibition of a printing operation (S143). After S143, the CPU 31 terminates the temperature management process.

[Printing Process]

Subsequently, referring to FIG. 7, an explanation will be provided of a printing process as one of specific controls for the aforementioned printing modes. In the printing process, the printer 100 performs a printing operation in accordance with temperature. The printing process is performed by the CPU 31 of the printer 100 in response to a print start condition being satisfied.

In the printing process, firstly, the CPU 31 determines whether a printing operation is prohibited (S200). When a printing operation is prohibited in the aforementioned temperature management process, the CPU 31 is not allowed to begin the printing process. Therefore, when determining that a printing operation is prohibited (S200: Yes), the CPU 31 waits until the prohibition of a printing operation is released. It is noted that when determining that a printing operation is prohibited (S200: Yes), the CPU 31 may display an error message and terminate the printing process.

When determining that a printing operation is not prohibited (S200: No), the CPU 31 determines whether the outside temperature T2 is equal to or less than the threshold C (S201). When determining that the outside temperature T2 is equal to or less than the threshold C (S201: Yes), the CPU 31 further determines whether the outside temperature T2 is equal to or less than the threshold K (S202). When determining that the outside temperature T2 is equal to or less than the threshold C (S202: Yes), the CPU 31 further determines whether the inside temperature T1 is equal to or less than the threshold D (S203).

When determining that the inside temperature T1 is higher than the threshold D (S203: No), the CPU 31 prohibits a printing operation and operates the fan 80 at the maximum rotational speed (S211). The step S211 is an operation to be executed under the temperature condition in the area (5) shown in FIG. 4. After S211, the CPU 31 determines whether the inside temperature T1 is equal to or less than the threshold E (S212). When determining that the inside temperature T1 is higher than the threshold E (S212: No), the CPU 31 waits until the inside temperature T1 becomes equal to or less than the threshold E. When determining that the inside temperature T1 is equal to or less than the threshold E (S212: Yes), the CPU 31 stops the fan 80 and releases the prohibition of a printing operation (S213).

After S213, or when determining that the inside temperature T1 is equal to or less than the threshold D (S203: Yes), the CPU 31 controls the printing unit 10 to perform a printing operation at the maximum speed (S204). The step S204 is an operation to be executed under the temperature condition in the area (1) shown in FIG. 4. After that, the CPU 31 determines whether the printing operation has been finished (S205). When determining that the printing operation has not been finished (S205: No), the CPU 31 goes back to S203 and continues to perform the printing operation. When determining that the printing operation has been finished (S205: Yes), the CPU 31 terminates the printing process. It is noted that the printing operation may be determined to be finished, e.g., when all pages are completely printed or when a cancel instruction is input.

Meanwhile, when determining that the outside temperature T2 is higher than the threshold C (S201: No), the CPU 31 performs a first high-temperature printing process (S221). The first high-temperature printing process is one of printing processes to be executed at a high temperature. FIG. 8 is a flowchart showing a procedure of the first high-temperature printing process.

In the first high-temperature printing process, firstly, the CPU 31 determines whether the inside temperature T1 is equal to or less than the threshold F (S241). When determining that the inside temperature T1 is equal to or less than the threshold F (S241: Yes), the CPU 31 controls the printing unit 10 to perform a printing operation at the maximum speed (S261). The step S261 is an operation to be executed under the temperature condition in the area (3) shown in FIG. 4.

When determining that the inside temperature T1 is higher than the threshold F (S241: No), the CPU 31 further determines whether the inside temperature T1 is equal to or less than the threshold D (S242). When determining that the inside temperature T1 is higher than the threshold D (S242: No), the CPU 31 prohibits a printing operation and operates the fan 80 at the maximum rotational speed (S251). The step S251 is an operation to be executed under the temperature condition in the area (5) shown in FIG. 4. After S251, the CPU 31 determines whether the inside temperature T1 is equal to or less than the threshold E (S252). When determining that the inside temperature T1 is higher than the threshold E (S252: No), the CPU 31 waits until the inside temperature T1 becomes equal to or less than the threshold E. When determining that the inside temperature T1 is equal to or less than the threshold E (S252: Yes), the CPU 31 stops the fan 80 and releases the prohibition of a printing operation (S253).

After S253, or when determining that the inside temperature T1 is equal to or less than the threshold D (S242:Yes), the CPU 31 controls the printing unit 10 to perform an intermittent printing operation at the half speed (S244). The step S244 is an operation to be executed under the temperature condition in the area (4) shown in FIG. 4. Thereby, it is possible to suppress a rise in the inside temperature T1 and print a larger number of sheets.

After S244 or S261, the CPU 31 determines whether the printing operation has been finished (S245). When determining that the printing operation has not been finished (S245: No), the CPU 31 goes back to S241 and continues to perform the printing operation. When determining that the printing operation has been finished (S245: Yes), the CPU 31 terminates the first high-temperature printing process. After terminating the first high-temperature printing process, the CPU 31 returns to the printing process shown in FIG. 7 and terminates the printing process.

Referring back to FIG. 7, when determining that the outside temperature T2 is higher than the threshold K (S202: No), the CPU 31 performs a second high-temperature printing process (S231). The second high-temperature printing process is one of the printing processes to be executed at a high temperature. FIG. 9 is a flowchart showing a procedure of the second high-temperature printing process.

In the second high-temperature printing process, firstly, the CPU 31 determines whether the inside temperature T1 is equal to or less than the threshold F (S271). When determining that the inside temperature T1 is equal to or less than the threshold F (S271: Yes), the CPU 31 controls the printing unit 10 to perform a printing operation at the maximum speed (S291). The step S291 is an operation to be executed under the temperature condition in the area (1) shown in FIG. 4.

When determining that the inside temperature T1 is higher than the threshold F (S271: No), the CPU 31 further determines whether the inside temperature T1 is equal to or less than the threshold D (S272). When determining that the inside temperature T1 is higher than the threshold D (S272: No), the CPU 31 prohibits a printing operation and operates the fan 80 at the maximum rotational speed (S281). The step S281 is an operation to be executed under the temperature condition in the area (5) shown in FIG. 4. After S281, the CPU 31 determines whether the inside temperature T1 is equal to or less than the threshold E (S282). When determining that the inside temperature T1 is higher than the threshold E (S282: No), the CPU 31 waits until the inside temperature T1 becomes equal to or less than the threshold E. When determining that the inside temperature T1 is equal to or less than the threshold E (S282: Yes), the CPU 31 stops the fan 80 and releases the prohibition of a printing operation (S283).

After S283, or when determining that the inside temperature T1 is equal to or less than the threshold D (S272: Yes), the CPU 31 determines whether duplex printing is specified as a printing mode (S273). When determining that duplex printing is specified (S273: Yes), the CPU 31 controls the printing unit 10 to perform duplex printing at the half speed (S274). Meanwhile, when determining that simplex printing is specified (S273: No), the CPU 31 controls the printing unit 10 to perform simplex printing at the maximum speed (S275). Each of the steps S274 and S275 is an operation to be executed under the temperature condition in the area (2) shown in FIG. 4. In the duplex printing, the inside temperature T1 is likely to rise more easily than in the simplex printing. Therefore, when it is determined that duplex printing is specified, the duplex printing is performed at the half speed. Thereby, it is possible to suppress a rise in the inside temperature T1 and print a larger number of sheets.

After S274, S275, or S291, the CPU 31 determines whether the printing operation has been finished (S276). When determining that the printing operation has not been finished (S276: No), the CPU 31 goes back to S271 and continues to perform the printing operation. When determining that the printing operation has been finished (S276: Yes), the CPU 31 terminates the second high-temperature printing process. After terminating the second high-temperature printing process, the CPU 31 returns to the printing process shown in FIG. 7 and terminates the printing process.

[Cooling Process]

Subsequently, referring to FIG. 10, an explanation will be provided of a cooling process to cool the inside of the printer 100 after completion of the printing operation. The cooling process is performed by the CPU 31 of the printer 100, on condition that after completion of the print job, the printer 100 has not accepted a next print job. Further, the cooling process may be performed in response to an initial operation being completed by the printing unit 10 when the printer 100 is turned on or when the printer 100 is restored into the ready state from the power-saving state. The initial operation, which is to be executed by the printing unit 10 when the printer 100 is turned on or when the printer 100 is restored into the ready state from the power-saving state, may include an agitating operation for one or more development units 4. Namely, for instance, the cooling process may be performed in response to the agitating operation being completed by the printing unit 10.

In the cooling process, firstly, the CPU 31 determines whether the inside temperature T1 is equal to or less than a threshold P (S301). The threshold P is such a temperature that as far as the inside temperature T1 is equal to or less than the threshold P, the inside temperature T1 is assumed not to exceed the threshold D even if the inside temperature T1 temporarily increases after the cooling process is started. The threshold P is set to a temperature lower than the threshold F. In the illustrative embodiment, the threshold P is 39° C. The threshold P is an example of an inside particular temperature.

When determining that the inside temperature T1 is higher than the threshold P (S301: No), the CPU 31 determines whether a predetermined period of time has elapsed since the start of the cooling process (S302). In the illustrative embodiment, the predetermined period of time is set to 5 minutes. When determining that the predetermined period of time has not elapsed since the start of the cooling process (S302: No), the CPU 31 operates the fan 80 at a half rotational speed (S311). Thereby, it is possible to lower the inside temperature T1 within an idle period of time during which a printing operation is not performed. After S311, the CPU 31 goes back to S301.

When determining that the predetermined period of time has elapsed since the start of the cooling process (S302: Yes), or when determining that the inside temperature T1 is equal to or less than the threshold P (S301: Yes), the CPU 31 stops the fan 80 (S303). It is noted that the CPU 31 skips S303 when the inside temperature T1 is equal to or less than the threshold P, and the fan 80 has not been operated, from the beginning. After S303, the CPU 31 terminates the cooling process.

In the printer 100, even though the driving motor of the process units 50 or the heater of the fuser assembly 8 is turned on and thereafter turned off, the inside temperature T1 may temporarily rise by remaining heat of the turned-off element. It is not desired that the cooling operation is started in response to the temporary rise of the inside temperature T1, and that a printing operation is restricted by the cooling operation. Therefore, the inside temperature T1 is prevented from exceeding the threshold D due to its temporary rise. Further, if the fan 80 is operated for a fixed period of time, even though a temperature rise caused after a printing operation (e.g., a printing operation for a single sheet) is small, the fan 80 might be wastefully operated for an unnecessarily long period of time. Thus, in the cooling process of the illustrative embodiment, it is determined whether to operate the fan 80, based on an actual temperature inside the printer 100. Thereby, it is possible to avoid a wasteful operation of the fan 80 and reduce an execution frequency of the cooling operation.

In the aforementioned cooling process, the fan 80 is operated at the half rotational speed. Nonetheless, the fan 80 may be operated at the maximum rotational speed. When the fan 80 is operated at the maximum rotational speed, the inside of the printer 100 is cooled more efficiently than when the fan 80 is operated at the half rotational speed. In this regard, however, the operation of the fan 80 at the maximum rotational speed makes louder noises than that at the half rotational speed. Therefore, the half rotational speed is preferable when a higher priority is put on suppressing noises.

As detailed above, according to the illustrative embodiment, under the temperature condition in the area (2) shown in FIG. 4 (i.e., in the case where the inside temperature T1 and the outside temperature T2 are high), when duplex printing is specified, the printer 100 performs the duplex printing with the half speed as a sheet conveyance speed. Thereby, it is possible to suppress a rise in the inside temperature T1 and delay the inside temperature T1 to reach the threshold D as the cooling-requiring temperature above which the cooling operation is required to be executed. Thus, it is possible to print a larger number of sheets. Meanwhile, in simplex printing, since a quantity of heat taken away by sheets per unit time is larger than that in the duplex printing, the inside temperature T1 is hard to increase. Therefore, the printer 100 performs the simplex printing with the maximum speed as a sheet conveyance speed, in preferential consideration of productivity. Thereby, it is possible to suppress a reduction in productivity, in accordance with temperature.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiments of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

In the aforementioned illustrative embodiment, aspects of the present disclosure are applied to a printer. Nonetheless, aspects of the present disclosure may be applied to apparatuses and devices having an image forming function such as copy machines, multi-function peripherals, and facsimile machines. Further, aspects of the present disclosure may be applied to apparatuses and devices configured specifically for monochrome printing as well as apparatuses and devices configured to perform color printing.

According to the aforementioned illustrative embodiment, in the area (4) shown in FIG. 4, the printer 100 performs intermittent printing at the half speed, regardless of whether duplex printing is specified. Nonetheless, in the same manner as executed under the temperature condition in the area (2) in FIG. 4, the printer 100 may switch the control mode depending on whether duplex printing is specified. For instance, in the simplex printing, the printer 100 may perform intermittent printing at the maximum speed. Further, in the duplex printing, the printer 100 may perform intermittent printing at the half speed. Moreover, under the temperature condition in the area (4) in FIG. 4 as well, the printer 100 may perform the same operations as executed in the area (2) in FIG. 4.

In the aforementioned illustrative embodiment, the dust-proof filter 81 is attached to the fan 80. Nonetheless, the dust-proof filter 81 may not be attached to the fan 80. When the dust-proof filter 81 is not attached to the fan 80, the fan 80 has a higher cooling capability than when the dust-proof filter 81 is attached to the fan 80. Therefore, at least one of the NVRAM 34 and the ROM 32 may store a flag indicating whether the dust-proof filter 81 is attached to the fan 80. In this case, the printer 100 may change a printing operation depending on whether the flag is set ON or OFF. For instance, under the temperature condition in the area (2) shown in FIG. 4, when the dust-proof filter 81 is attached to the fan 80, the printer 100 may perform the same operations as exemplified in the aforementioned illustrative embodiment. Meanwhile, when the dust-proof filter 81 is not attached to the fan 80, the printer 100 may perform the same operations as executed in the area (1) shown in FIG. 4. It is noted that the flag indicating whether the dust-proof filter 81 is attached to the fan 80 may be a value variable by a user setting or a fixed value set before factory shipment.

The processes exemplified in the aforementioned illustrative embodiment may be executed by one or more hardware elements such as one or more CPUs, one or more ASICs, or a combination of one or more CPUs and one or more ASICs. The processes exemplified in the aforementioned illustrative embodiment may be executed in accordance with computer software stored on a non-transitory computer-readable medium or a method adapted to be implemented on one or more hardware elements.

What is claimed is:

1. An image forming apparatus comprising:

a plurality of frames;

an image forming assembly supported by the plurality of frames, the image forming assembly being configured to perform image formation on a sheet;

a first temperature sensor disposed inside a space between the plurality of frames, the first temperature sensor being configured to detect a first temperature inside the space between the plurality of frames by outputting a signal corresponding to the first temperature;

a second temperature sensor disposed outside the space between the plurality of frames, the second temperature sensor being configured to detect a second temperature outside the space between the plurality of frames by outputting a signal corresponding to the second temperature; and a controller configured to:

when the first temperature detected by the first temperature sensor is higher than an inside threshold temperature, the second temperature detected by the second temperature sensor is higher than an outside threshold temperature, and simplex image formation is specified as an image forming mode, control the image forming assembly to perform image formation on a single side of the sheet while conveying the sheet at a first conveyance speed;

when the first temperature detected by the first temperature sensor is higher than an inside threshold temperature, the second temperature detected by the second temperature sensor is higher than an outside threshold temperature, and duplex image formation is specified as the image forming mode, control the image forming assembly to perform image formation on both sides of the sheet while conveying the sheet at a second conveyance speed, the second conveyance speed being lower than the first conveyance speed; and in at least one of a case where the first temperature is equal to or less than the inside threshold temperature and a case where the second temperature is equal to or less than the outside threshold temperature, control the image forming assembly to perform image formation on the sheet while conveying the sheet at the first conveyance speed.

2. The image forming apparatus according to claim 1, further comprising a fan configured to generate an air current inside the image forming apparatus, wherein the controller is further configured to, when the first temperature detected by the first temperature sensor is higher than an inside limit temperature, prohibit the image forming assembly from performing image formation and operate the fan, the inside limit temperature being higher than the inside threshold temperature.

3. The image forming apparatus according to claim 2, wherein the controller is further configured to, when the first temperature detected by the first temperature sensor becomes equal to or less than an inside permissible temperature from a temperature higher than the inside limit temperature, stop the fan and release the prohibition of image formation, the inside permissible temperature being higher than the inside threshold temperature and lower than the inside limit temperature.

4. The image forming apparatus according to claim 1, further comprising a fan configured to generate an air current inside the image forming apparatus, wherein the controller is further configured to, when the second temperature detected by the second temperature sensor is higher than an outside limit temperature, and the first temperature detected by the first temperature sensor is equal to or less than a temperature obtained by adding an adjustment value to the second temperature, operate the fan, the outside limit temperature being higher than the outside threshold temperature.

5. The image forming apparatus according to claim 4, wherein the controller is further configured to stop the fan in response to the second temperature falling by a predetermined temperature value from a state that the second temperature is higher than the outside limit temperature and that the first temperature is equal to or less than the temperature obtained by adding the adjustment value to the second temperature.

6. The image forming apparatus according to claim 4, wherein the controller is further configured to, when the first temperature is higher than the inside threshold temperature, and the second temperature is higher than a second outside threshold temperature, in an image forming operation for at least a particular number of sheets, control the image forming assembly to interrupt the image forming operation for a particular period of time after continuously performing the image forming operation for the particular number of sheets, the second outside threshold temperature being lower than the outside limit temperature and higher than the outside threshold temperature.

7. The image forming apparatus according to claim 1, further comprising a fan configured to generate an air current inside the image forming apparatus, wherein the controller is further configured to, when the second temperature detected by the second temperature sensor is higher than an outside limit temperature, and the first temperature detected by the first temperature sensor is equal to or more than a temperature obtained by adding a regulation value to the second temperature, prohibit the image forming assembly from performing image formation and operate the fan, the outside limit temperature being higher than the outside threshold temperature.

8. The image forming apparatus according to claim 7, wherein the controller is further configured to:

when the second temperature is higher than the outside limit temperature, and the first temperature is equal to or more than the temperature obtained by adding the regulation value to the second temperature, prohibit the image forming assembly from performing image formation, and operate the fan;

thereafter, when the first temperature becomes lower than the temperature obtained by adding the regulation value to the second temperature, stop the fan; and further, when the second temperature becomes equal to or less than an outside permissible temperature, release the prohibition of image formation, the outside permissible temperature being higher than the outside threshold temperature and lower than the outside limit temperature.

9. The image forming apparatus according to claim 1, further comprising a fan configured to generate an air current inside the image forming apparatus, wherein the controller is further configured to, after the image forming assembly completes image formation, operate the fan until at least one of a plurality of conditions is satisfied, the conditions including:

a condition that the first temperature detected by the first temperature sensor is equal to or less than an inside particular temperature, the inside particular temperature being lower than the inside threshold temperature; and a condition that a predetermined period of time elapses since the fan has begun to be operated.

10. The image forming apparatus according to claim 1, further comprising a fuser assembly configured to fix, onto a sheet, an image formed on the sheet by the image forming assembly.

11. The image forming apparatus according to claim 10, further comprising a re-conveyance guide configured to:

reverse a conveyance direction of a sheet to be re-conveyed for duplex image formation, the sheet having an image fixedly formed on a first side thereof via the image forming assembly and the fuser assembly; and guide the sheet to the image forming assembly to form an image on a second side of the sheet.

12. The image forming apparatus according to claim 1, wherein the controller comprises:

a processor; and a memory storing processor-executable instructions that, when executed by the processor, cause the processor to:

when the first temperature is higher than the inside threshold temperature, and the second temperature is higher than the outside threshold temperature, and simplex image formation is specified, control the image forming assembly to perform the simplex image formation at the first conveyance speed;

when the first temperature is higher than the inside threshold temperature, and the second temperature is higher than the outside threshold temperature, and duplex image formation is specified, control the image forming assembly to perform the duplex image formation at the second conveyance speed; and when the first temperature is equal to or less than the inside threshold temperature, and the second temperature is equal to or less than the outside threshold temperature, control the image forming assembly to perform image formation at the first conveyance speed.

13. A method adapted to be implemented on a processor coupled with an image forming apparatus, the image forming apparatus comprising a plurality of frames, an image forming assembly supported by the frames, a first temperature sensor, and a second temperature sensor, the method comprising:

determining whether a second temperature detected by the second temperature sensor is equal to or less than an outside threshold temperature, the second temperature sensor being disposed outside a space between the plurality of frames, the second temperature sensor being configured to detect the second temperature outside the space between the plurality of frames by outputting a signal corresponding to the second temperature;

when it is determined that the second temperature is higher than the outside threshold temperature, determining whether a first temperature detected by the first temperature sensor is equal to or less than an inside threshold temperature, the first temperature sensor being disposed inside the space between the plurality of frames, the first temperature sensor being configured to detect the first temperature inside the space between the plurality of frames by outputting a signal corresponding to the first temperature;

when it is determined that the first temperature is higher than the inside threshold temperature, determining whether duplex image formation is specified as an image forming mode;

when it is determined that simplex image formation is specified, controlling the image forming assembly to perform image formation on a single side of a sheet while conveying the sheet at a first conveyance speed;

when it is determined that duplex image formation is specified, controlling the image forming assembly to perform image formation on both sides of the sheet while conveying the sheet at a second conveyance speed, the second conveyance speed being lower than the first conveyance speed; and when it is determined that the second temperature is equal to or less than the outside threshold temperature or that the first temperature is equal to or less than the inside threshold temperature, controlling the image forming assembly to perform image formation on the sheet while conveying the sheet at the first conveyance speed.

14. A non-transitory computer-readable medium storing computer-readable instructions that are executable by a processor coupled with an image forming apparatus, the image forming apparatus comprising a plurality of frames, an image forming assembly supported by the frames, a first temperature sensor, and a second temperature sensor, the instructions being configured to, when executed by the processor, cause the processor to:

determine whether a second temperature detected by the second temperature sensor is equal to or less than an outside threshold temperature, the second temperature sensor being disposed outside a space between the plurality of frames, the second temperature sensor being configured to detect the second temperature outside the space between the plurality of frames by outputting a signal corresponding to the second temperature;

when determining that the second temperature is higher than the outside threshold temperature, determine whether a first temperature detected by the first temperature sensor is equal to or less than an inside threshold temperature, the first temperature sensor being disposed inside the space between the plurality of frames, the first temperature sensor being configured to detect the first temperature inside the space between the plurality of frames by outputting a signal corresponding to the first temperature;

when determining that the first temperature is higher than the inside threshold temperature, determine whether duplex image formation is specified as an image forming mode;

when determining that simplex image formation is specified, control the image forming assembly to perform image formation on a single side of a sheet while conveying the sheet at a first conveyance speed;

when determining that duplex image formation is specified, control the image forming assembly to perform image formation on both sides of the sheet while conveying the sheet at a second conveyance speed, the second conveyance speed being lower than the first conveyance speed; and when determining that the second temperature is equal to or less than the outside threshold temperature or that the first temperature is equal to or less than the inside threshold temperature, control the image forming assembly to perform image formation on the sheet while conveying the sheet at the first conveyance speed.

* * * * *